United States Patent [19]

Bird et al.

[11] Patent Number: 4,685,119

[45] Date of Patent: Aug. 4, 1987

[54] MOVABLE ANODE X-RAY SOURCE WITH ENHANCED ANODE COOLING

[75] Inventors: Charles R. Bird, Ypsilanti; Paul D. Rockett, Ann Arbor, both of Mich.

[73] Assignee: KMS Fusion, Inc., Ann Arbor, Mich.

[21] Appl. No.: 720,877

[22] Filed: Apr. 8, 1985

[51] Int. Cl.[4] ..... H01J 35/10

[52] U.S. Cl. ..... 378/130; 378/127; 378/141; 378/142; 378/199; 378/200; 378/144

[58] Field of Search ..... 378/125, 127, 128, 130, 378/141-142, 144, 200, 199

[56] References Cited

U.S. PATENT DOCUMENTS 3,790,836 2/1974 Braun ..... 378/127

FOREIGN PATENT DOCUMENTS 0053050 4/1980 Japan ..... 378/127

*Primary Examiner*—Craig E. Church

*Assistant Examiner*—John C. Freeman

*Attorney, Agent, or Firm*—Barnes, Kisselle, Raisch, Choate, Whittemore & Hulbert

[57] ABSTRACT

An x-ray source having a cathode and a disc-shaped anode with a peripheral surface at constant radius from the anode axis opposed to the cathode. The anode has stub axle sections rotatably carried in heat conducting bearing plates which are mounted by thermoelectric coolers to bellows which normally bias the bearing plates to a retracted position spaced from opposing anode side faces. The bellows cooperate with the x-ray source mounting structure for forming closed passages for heat transport fluid. Flow of such fluid under pressure expands the bellows and brings the bearing plates into heat conducting contact with the anode side faces. A worm gear is mounted on a shaft and engages serrations in the anode periphery for rotating the anode when flow of coolant is terminated between x-ray emission events.

12 Claims, 5 Drawing Figures

MOVABLE ANODE X-RAY SOURCE WITH ENHANCED ANODE COOLING

The Government has rights to this invention pursuant to Contract No. DE-AC08-82DP40152 awarded by the U.S. Department of Energy.

The present invention is directed to x-ray sources of a type having an anode mounted for translation, specifically rotation, between x-ray emission events, and more specifically to cooling of such a rotatable anode during x-ray generation.

It is conventional practice in the art of rotatable anode x-ray sources to provide for fluid cooling of the anode in such a way that the coolant must be transported through one or more rotary seals. For example, coolant may be fed through the anode-rotation shaft and into the inside of the anode. Such rotary seals are subject to wear and may leak coolant and/or air into the x-ray vacuum chamber, and therefore require continual maintenance.

A general object of the present invention is to provide an x-ray source having an anode which is mounted for translation with respect to the cathode between emission events and in which the anode is cooled during x-ray generation in a manner which does not require use of rotary seals and like devices.

A more specific object of the invention is to provide a rotatable anode x-ray source having enhanced capacity for cooling the anode during x-ray generation.

The invention, together with additional objects, features and advantages thereof, will be best understood from the following description, the appended claims and the accompanying drawings in which:

Figure 1:
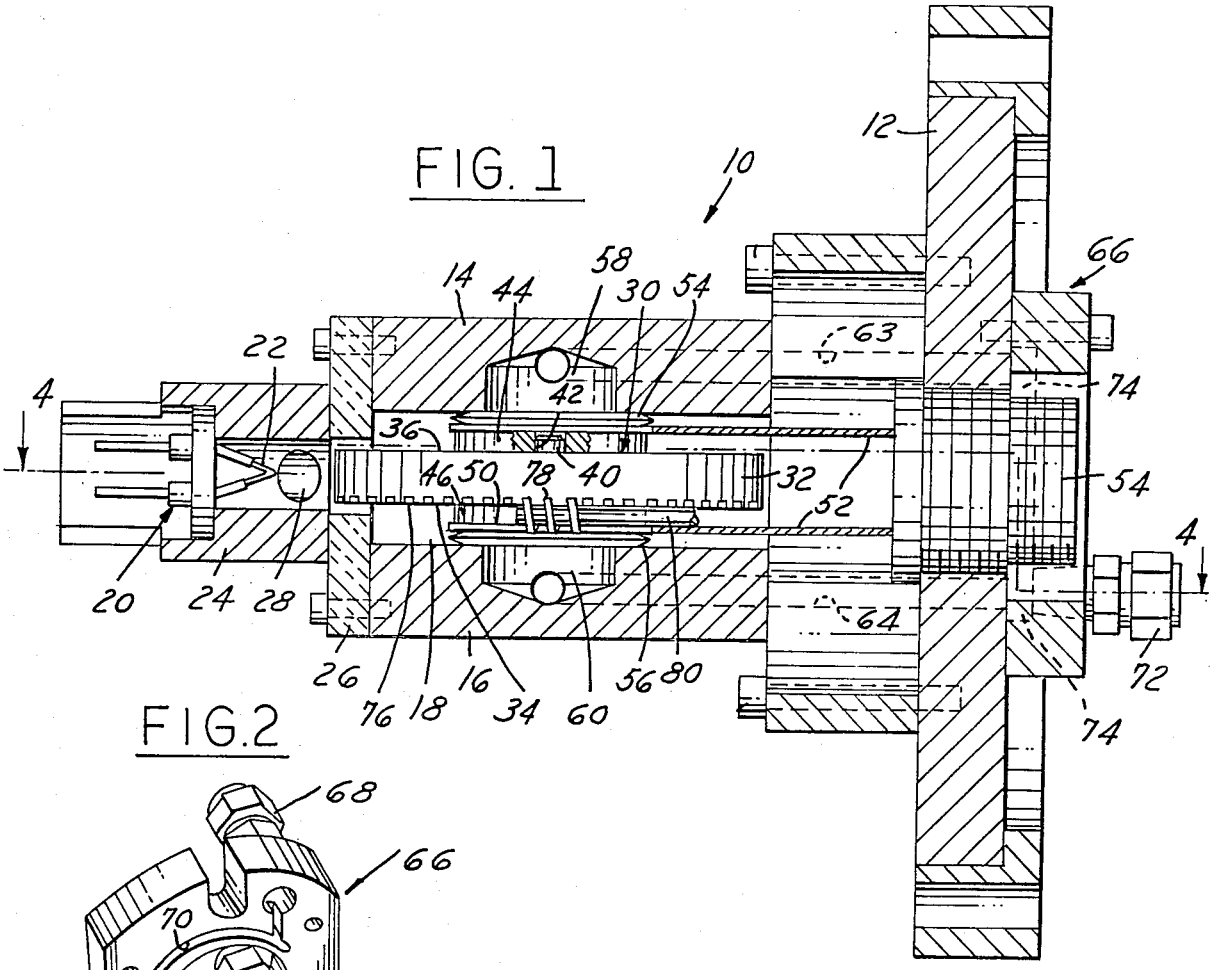
FIG. 1 is a sectional view in side elevation bisecting a rotatable anode x-ray source in accordance with a presently preferred embodiment of the invention.

The drawings illustrate a presently preferred embodiment 10 of a rotatable anode x-ray source in accordance with the present invention as including a vacuum flange or base 12 for mounting source 10 to a vacuum chamber or the like. A pair of parallel side plates 14,16 are affixed to and project from vacuum flange 12 forming an anode chamber 18 therebetween. A cathode 20 having an electron emission filament 22 is mounted by the insulation blocks 24,26 to plates 14,16 remotely of vacuum flange 12, with filament 22 projecting toward chamber 18. Cathode mounting block 24 has a pair of windows 28 for emission of x-rays generated within anode chamber 18.

A disc-shaped anode 30 is positioned within anode chamber 18 and has a circumferentially continuous radially outwardly facing surface 32 opposed to cathode 20 at constant radius from an anode central axis. A pair of oppositely facing parallel anode side faces 34,36 are perpendicular to the anode axis. At least surface 32 of anode 30 is constructed of material which emits x-rays upon bombardment of electrons from cathode 20. Anode 30 has a central axle 40 which projects from side faces 34,36 to form coaxial stub axle sections. These stub axle sections are respectively rotatably received within the central openings 42 of the opposed contact bearing plates 44,46. Contact plates 44,46 are of uniform thickness and are constructed of suitable heat conductive material.

A thermoelectric cooler 48,50 is affixed to each plate 44,46 on the side thereof remote from anode 30. Coolers 48,50 are conventional devices responsive to application of electrical energy for conducting thermal energy therethrough, and therefore have electrical conductors 52 therefrom to a connector 54 on vacuum flange 12 for selective application of such electrical energy. Coolers 48,50, having heat conducting contact bearing plates 44,46 affixed thereto, are respectively cantilevered from side plates 14,16 by the expansible bellows 54,56. Bellows 54,56 are sealed to coolers 48,50 and to plates 14,16 so as to form enclosed chambers 58,60 for passage of a heat transport fluid or coolant such as water, into contact with the faces of coolers 48,50 remote from anode 30. Bellows 54,56 are so constructed as to normally bias bearing plates 44,46 away from anode 30, the length of axle 40 being sufficient to carry anode 30 when bearing plates 44,46 are so retracted.

Figure 2:
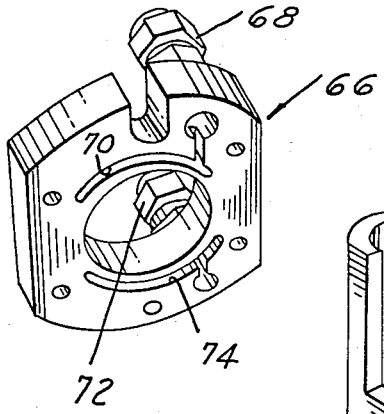
FIG. 2 is a perspective view of the coolant distribution manifold in the source of FIG. 1.
Figure 3:
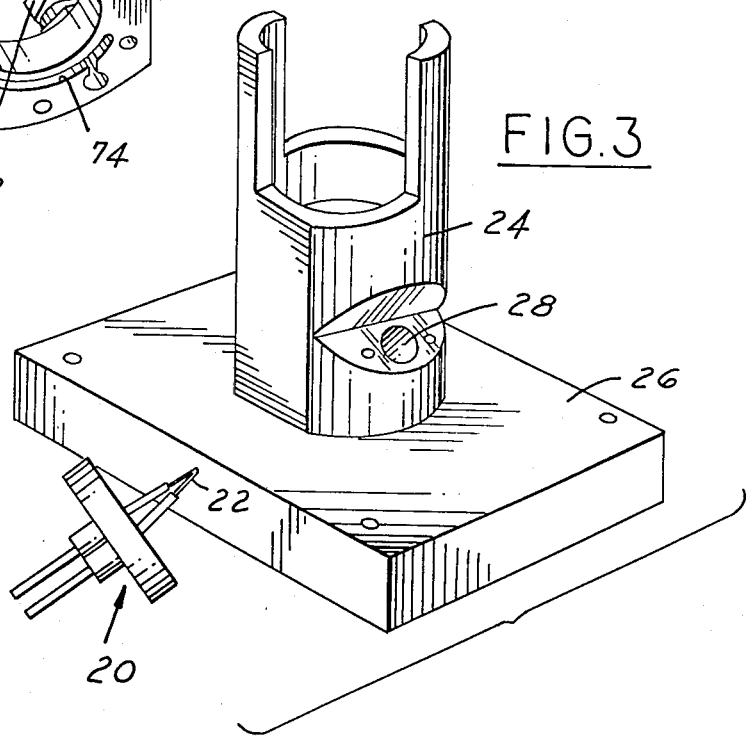
FIG. 3 is a partially exploded perspective view of the cathode subassembly in the source of FIG. 1.
Figure 4:
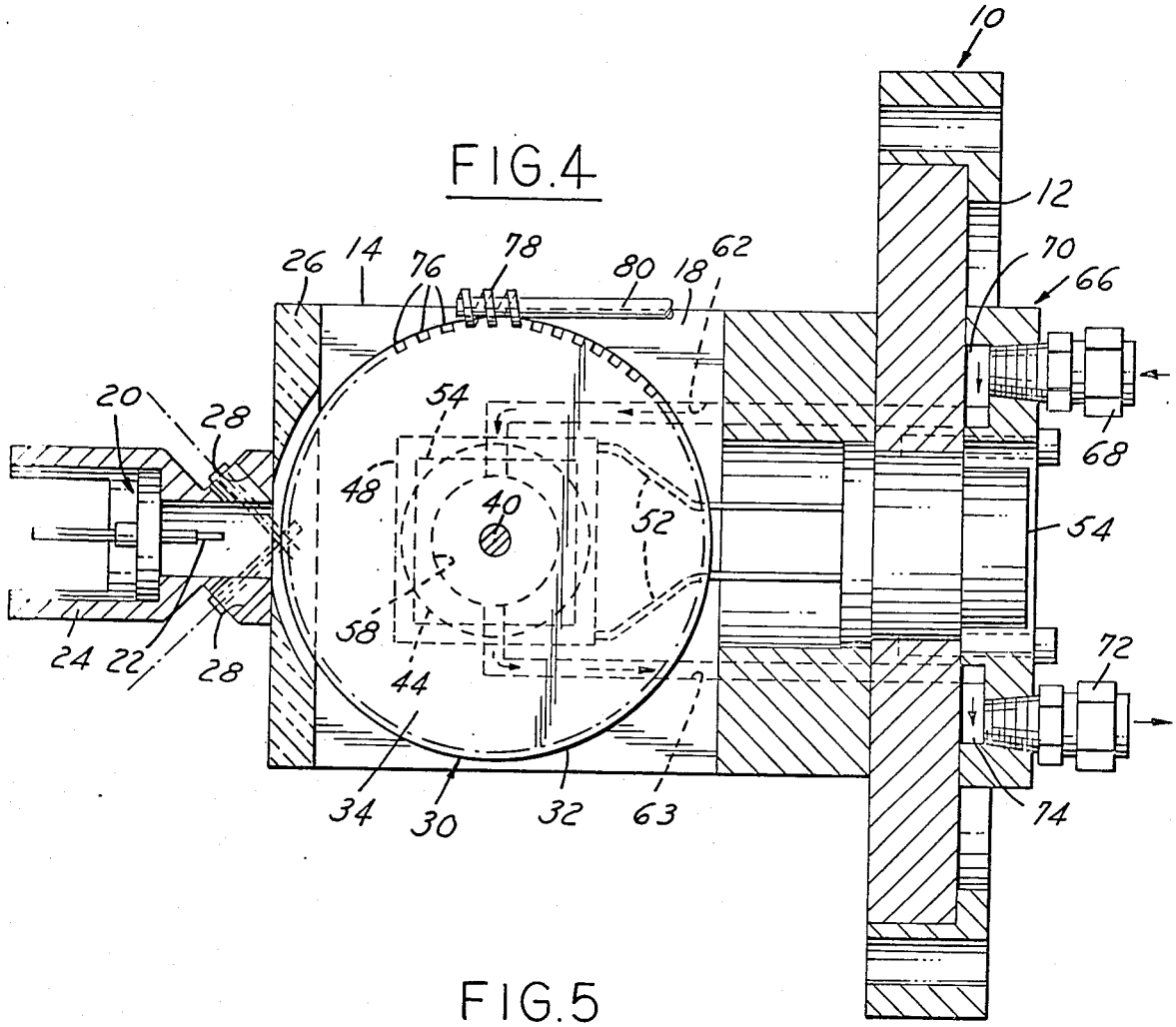
FIG. 4 is a sectional view taken substantially along the line 4—4 in FIG. 1.
Figure 5:
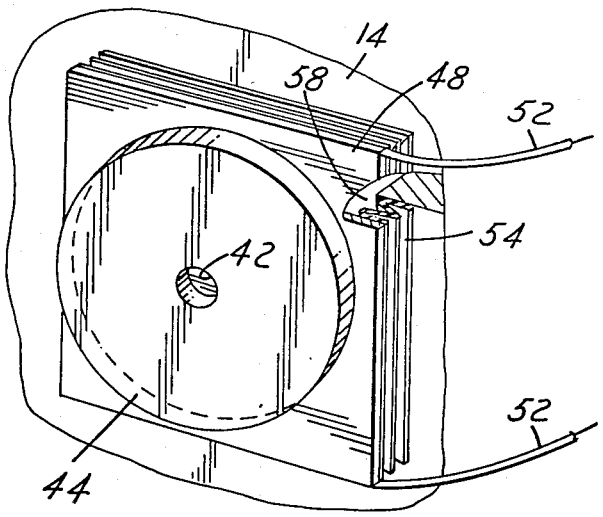
FIG. 5 is a fragmentary perspective view which illustrates the heat sink mounting arrangement in accordance with the preferred embodiment of the invention.

A fluid inlet passage 62 (FIG. 4) extends through side plate 14 to chamber 58, and a fluid outlet passage 63 likewise extends from chamber 58 through side plate 14. A complementary fluid inlet passage (not shown) and outlet passage 64 (FIG. 1) extend to and from chamber 60 through side plate 16. A coolant manifold 66 is mounted externally of vacuum flange 12, and has a fluid inlet nipple 68 which communicates with an arcuate fluid passage 70 (FIG. 2) for feeding inlet coolant to chambers 58,60 through passage 62 in side plate 14 and the corresponding passage in side plate 16. An outlet nipple 72 is likewise mounted on manifold 66 and communicates with the arcuate passage 74 (FIG. 2) for receiving fluid from chambers 58,60 through outlet passages 63,64. A plurality of serrations or grooves 76 are formed in a circumferential array around one axial edge of anode face 32. A worm gear 78 is affixed to one end of a shaft 80 and engages serrations 76. Shaft 80 projects (in a manner not shown) through vacuum flange 12 for selective rotation of anode 30.

In operation, anode 30 is first rotated by means of shaft 80 and worm gear 78 to a desired angular position. Heat transport fluid, such as water, is then circulated under pressure to inlet nipple 68, chambers 58,60 and outlet nipple 72. Such water pressure expands bellows 54,56, bringing bearing plates 44,46 into opposed heat-conducting facing engagement with anode side faces 36,34. Coolers 48,50 are then energized, and cathode 20 may be energized as desired for generating x-rays which pass through windows 28. (Anode 30 is grounded through bearing plates 44,46 and coolers 48,50.) When it is desired to rotate anode 30 between x-ray emission events, coolant flow is terminated so that bellows 54,56 retract bearing plates 44,46 from facing contact with anode 30. With the bearing plates thus spaced from the opposing anode surfaces, anode 30 may be rotated as desired by means of shaft 80 and worm gear 78.

The invention claimed is:

1. An x-ray source comprising: a cathode, an anode including a body with a first surface opposed to said cathode at fixed radius from a common axis and a side surface perpendicular to said axis, means mounting said anode for rotation about said axis, and cooling means for retractable heat-conducting engagement with said side surface of said anode, characterized in that said cooling means comprises a flat plate of heat conductive construction adjacent to said side surface, expansible means sealingly mounting said plate to support structure to resiliently urge said plate away from said anode side surface and cooperating with said support structure for forming a fluid chamber on a side of said plate remote from said anode, and means for circulating fluid into and through said chamber at pressure sufficient to expand said expansible means with respect to said support structure to bring said plate into heat conducting contact with said anode side surface.

2. The source set forth in claim 1 wherein said anode comprises a body having parallel side surfaces perpendicular to said axis; and wherein said cooling means comprises first and second heat sink means comprised of plates positioned on opposite sides of said anode body facing said anode side surfaces, first and second expansible mounting means sealingly mounting said plates to said support structure to form corresponding fluid chambers, and first and second means for selectively directing fluid into and through a corresponding one of said chambers to bring each said plate into heat-conducting facing engagement with a corresponding said side surface of said anode body.

3. The source set forth in claim 2 wherein said anode body comprises a disc, said first surface comprising a radially-facing peripheral surface at constant radius from said axis; and wherein said mounting means comprises means mounting said anode body for rotation about said axis.

4. The source set forth in claim 3 further comprising means coupled to said anode body for selectively rotating said anode body about said axis.

5. The source set forth in claim 6 wherein said cooling means further comprises first and second thermoelectric cooling means respectively carried by said first and second expansible means in surface contact with said plates and responsive to application of electrical energy for conducting heat energy from said anode to the heat transport fluid when said cooling means is in contact with said anode side surfaces.

6. The source set forth in claim 1 wherein said cooling means further comprises thermoelectric cooling means carried by said expansible means in heat conducting communication with said plate and responsive to application of electrical energy for transporting heat energy from said anode to the heat transport fluid when said cooling means is in contact with said anode.

7. An x-ray source comprising: a cathode for selective emission of electrons; a disc-shaped anode having a radially facing peripheral surface opposed to said cathode at constant radius from a central disc axis and a pair of flat axially facing opposed side faces perpendicular to said axis, at least said peripheral surface being constructed to emit x-rays when bombarded by electrons from said cathode; means mounting said anode for rotation about said axis; and means for cooling said anode comprising heat sink means positioned on opposite axial sides of said anode in spaced opposition to said side faces, expansible means sealingly affixed to respective said heat sink means to form chambers on sides of said heat sink means remote from said anode side faces, and means for circulating a heat transport fluid under pressure through both of said chambers so as to expand said expansible means and bring said heat sink means into opposed facing heat-transfer contact with said anode side faces.

8. The source set forth in claim 7 wherein said heat sink means comprises first and second thermoelectric cooling means respectively carried by said expansible means and responsive to electrical energy for conducting heat energy from said anode to the heat transport fluid when said heat sink means is in contact with said anode.

9. The source set forth in claim 8 wherein said heat sink means further comprises first and second heat sink plates of heat conductive construction respectively carried by said first and second thermoelectric cooling means for facing engagement with said anode side faces.

10. The source set forth in claim 9 wherein said mounting means comprises a pair of stub axle sections projecting from said anode, and an opening in each of said heat sink plates rotatably carrying a corresponding said stub axle section.

11. The source set forth in claim 10 further comprising means for selectively rotating said anode about said axis.

12. The source set forth in claim 11 wherein said selectively-rotating means comprises an array of serrations extending circumferentially around said anode, a worm gear positioned adjacent to the periphery of said anode in engagement with said array of serrations, and a shaft projecting from said worm gear for selectively rotating the same.

* * * * *

UNITED STATES PATENT AND TRADEMARK OFFICE

CERTIFICATE OF CORRECTION

PATENT NO. : 4,685,119

DATED : August 4, 1987

INVENTOR(S) : Charles R. Bird and Paul D. Rockett

It is certified that error appears in the above—identified patent and that said Letters Patent is hereby corrected as shown below:

Column 3. Line 37, "claim 6" should be "claim 4".

Signed and Sealed this

Twenty-fourth Day of November, 1987

*Attest:*

DONALD J. QUIGG

*Attesting Officer*

*Commissioner of Patents and Trademarks*